US009309608B2

(12) United States Patent
Stündl et al.

(10) Patent No.: US 9,309,608 B2
(45) Date of Patent: Apr. 12, 2016

(54) METHOD AND DEVICE FOR PRODUCING A CRIMPED MULTIFILAMENT THREAD

(71) Applicant: Oerlikon Textile GmbH & Co. KG, Remscheid (DE)

(72) Inventors: Mathias Stündl, Wedel (DE); Marco Kaulitzki, Nortorf (DE); Claus Matthies, Ehndorf (DE); Friedrich Lennemann, Neumünster (DE); Christian Hubert, Neumünster (DE); Ludger Legge, Ehndorf (DE); Jan Westphal, Schülp (DE); Jan Borchardt, Groβnapse (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 79 days.

(21) Appl. No.: 14/082,724

(22) Filed: Nov. 18, 2013

(65) Prior Publication Data

US 2014/0077408 A1 Mar. 20, 2014

Related U.S. Application Data

(63) Continuation-in-part of application No. PCT/EP2011/066535, filed on Sep. 22, 2011.

(30) Foreign Application Priority Data

Jun. 16, 2011 (DE) ..... 10 2011 104 289

(51) Int. Cl.
*D01D 13/02* (2006.01)
*D01D 5/22* (2006.01)
(Continued)

(52) U.S. Cl.
CPC ..... *D01D 5/22* (2013.01); *D01D 10/0409* (2013.01); *D01D 13/02* (2013.01); *D02G 1/12* (2013.01); *D02J 1/02* (2013.01); *D02J 1/08* (2013.01); *D02J 1/22* (2013.01)

(58) Field of Classification Search
CPC ..... D01D 5/08; D01D 5/22; D01D 10/0409; D01D 13/00; D01D 13/02; D01D 1/02; D01D 1/08; D01D 1/22
See application file for complete search history.

(56) References Cited

U.S. PATENT DOCUMENTS 6,085,395 A 7/2000 Weiss
6,094,790 A 8/2000 Weiss
(Continued)

FOREIGN PATENT DOCUMENTS

DE 4140469 A1 * 6/1993
EP 0 784 109 7/1997
GB 2 321 651 8/1998

OTHER PUBLICATIONS

PCT/EP2012/060338 International Search Report dated Nov. 22, 2012 (4 pages including English translation).

*Primary Examiner* — Yogendra Gupta
*Assistant Examiner* — Joseph Leyson
(74) *Attorney, Agent, or Firm* — Brinks Gilson & Lione; G. Peter Nichols

(57) ABSTRACT

A method and a device for producing a crimped multifilament thread are described. A multiplicity of filaments are extruded by means of a spinning machine, cooled and subsequently treated by a drawing device and a crimping device to form a crimped thread. Before the thread is wound up to form a bobbin, a multiplicity of intertwining knots is produced on the crimped thread by a treatment device. In order to obtain defined patterns of the intertwining knots within the thread, a pulse sequence of compressed air pulses at a predefined frequency is directed at the thread. The treatment device has a controllable blowing means.

4 Claims, 5 Drawing Sheets

(51) Int. Cl.

| | |
|---|---|
| ***D02J 1/08*** | (2006.01) |
| ***D02J 1/02*** | (2006.01) |
| ***D02J 1/22*** | (2006.01) |
| ***D01D 10/04*** | (2006.01) |
| ***D02G 1/12*** | (2006.01) |

(56) References Cited

U.S. PATENT DOCUMENTS

| | | | | |
|---|---|---|---|---|
| 6,119,320 | A | 9/2000 | Weiss | |
| 8,800,123 | B2 * | 8/2014 | Stundl | 28/271 |
| 8,904,608 | B2 * | 12/2014 | Kaulitzki | 28/271 |
| 9,027,214 | B2 * | 5/2015 | Kaulitzki et al. | 28/274 |
| 2009/0049669 | A1 * | 2/2009 | Lennemann et al. | 28/281 |
| 2012/0144633 | A1 * | 6/2012 | Kaulitzki | 28/271 |
| 2013/0247341 | A1 * | 9/2013 | Stundl | 28/254 |
| 2013/0263414 | A1 * | 10/2013 | Kaulitzki et al. | 28/274 |
| 2014/0068902 | A1 * | 3/2014 | Matthies et al. | 28/271 |
| 2014/0090220 | A1 * | 4/2014 | Matthies et al. | 28/274 |
| 2014/0103648 | A1 * | 4/2014 | Matthies et al. | 289/2 |
| 2014/0250646 | A1 * | 9/2014 | Stundl et al. | 28/274 |
| 2014/0366349 | A1 * | 12/2014 | Hubert et al. | 28/273 |

* cited by examiner

METHOD AND DEVICE FOR PRODUCING A CRIMPED MULTIFILAMENT THREAD

This application is a continuation-in-part of and claims the benefit of priority from PCT application PCT/EP2011/066535 filed Sep. 22, 2011; and German Patent Application 10 2011 104 289.3 filed Jun. 16, 2011, the disclosure of each is hereby incorporated by reference in its entirety.

BACKGROUND

The invention relates to a method for the production of a crimped multifilament thread suitable for forming a bulked continuous filament (BCF) a device for the production of a crimped multifilament thread.

In the manufacture of carpeting, for example by tufting or weaving, a so-called bulked continuous filament (BCF) is introduced as a pile thread, which was previously generated in a melt spinning process. In such multifilament threads, it is to be ensured particularly in the further processing that sufficient thread engagement between the filaments of the thread is present. The thread end of the filaments of the thread is ensured in the manufacturing process essentially by a variety of intertwined knots that are generated on the thread before winding the thread. Such intertwined knots are generated by a compressed air treatment of the thread. In order to allow proper processing of the thread to a carpet product, a certain knot stability and a relatively high number of intertwined knots per unit length are desired in the BCF thread.

In the production of a crimped multifilament thread, such intertwined knots are typically generated by swirling the filaments of the thread. Such a method and such a device are described by way of example in EP 0784109 B1. For swirling of the filaments, the thread is passed through a treatment channel of a swirl nozzle, in which a continuous stream of compressed air is directed crosswise to the thread. Depending on the thread guide, the geometric configuration of the treatment channel, and the pressure of the compressed air, intensive swirling is set in motion until the intertwined knots are on the thread. However, the number of interlacing knots per unit length of the thread produced, as well as the knots forming the filaments in the thread due to vibrations of the thread even with constant pressure of the compressed air, is not reproducible. Therefore, the knot stability and the spacing between the intertwined knots more or less depend on the vibrational behavior of the thread and may occur in greater allowances. Such fluctuations in the stability of the intertwined knots and the fluctuation in the number of intertwined knots per unit length of the thread leads to a very differently coloring with the undyed threads depending on the knot stability and number of knots. In the manufacturing of so-called Tricolor colored threads, in which a number of colored filament bundles are spun and subsequently combined to form a crimped thread, irregularities in the formation of the knots and the number of knots lead to undefined visual effects in the subsequent processing of the thread into a carpet material.

SUMMARY

It is the objective of the invention to provide a method for producing a crimped multifilament thread as well as a device for producing a crimped multifilament thread in such a way that the thread has reproducible and uniform intertwined knots to form the filament end.

Another objective of the invention is to provide a method and a device for producing a crimped multifilament thread, wherein a predetermined pattern of intertwined knots is generated on the thread and can be used for the pattern formation in a carpet product.

This object is achieved according to the method of the invention such that for the production of the intertwined knots a pulse sequence of compressed air pulses is directed at the thread at a predetermined frequency.

According to the invention, the device includes a treatment apparatus that has a controllable blowing apparatus to periodically produce an air compression impulse directed on the thread.

Advantageous further embodiments of the invention are described below.

The invention is based on the recognition that the intertwined knots in the thread may substantially affect the visual appearance of a carpet product. Thus a carpet could be generated, for example, in the processing of a multi-colored thread in a monofilament tufting device, in which superimposed regular pattern displays so-called repetition stripes. It has been found that by varying the knot stability as well as by varying the distances between the intertwined knots, this effect can be influenced in the thread. In that regard, the invention has the particular advantage that, depending on the desired pattern in the carpet, this effect can be utilized. In the present invention a directed compressed air pulse to the thread leads to a strong and spontaneous formation of intertwined knots. To that extent, a pattern of intertwined knots onto the thread can be achieved by the sequence of a number of compressed air pulses with a predetermined frequency The pulse sequence of the recurring compressed-air pulses ensures a reproducible pattern of intertwined knots onto the running thread. As a result, uniform or non-uniform sequences of intertwined knots in the thread can be produced.

In order to ensure the filament end of the thread is suitable for further processing, it is preferred that the frequency of the pulse sequence of the compressed air pulse is adjusted in response to a thread speed so that per one meter length, a number of at least 5 to 35 intertwined knots are produced in the thread. Depending on the type of thread (whether monocolor or tricolor) and depending on further processing, the desired number of intertwined knots are preset to the thread.

The process according to invention is particularly advantageously used at relatively high thread speeds. In order to generate a sufficient number of intertwined knots on the thread, according to an advantageous further embodiment of the invention's method, the thread is passed between two powered godets at a speed in the range between 2,000 m/min. and 6,000 m/min. Thus, the conduction qualities necessary for the development of the intertwined knots of the thread will be individually set by the powered godets.

The embodiment of the variation in which the compressed air pulses are generated in the thread guide track by a rotating powered nozzle ring with a thread guide track with at least one nozzle bore, is particularly advantageous in generating in a reproducible fashion the pressure pulses of air at a relatively high frequency. Thus, the nozzle bore is connected by periodic rotation of the nozzle ring with a pressure source, so that for a short period of time a stream of pressurized air is directed through the nozzle orifice into the thread track.

A further particular advantage of the production of pulses of compressed air by means of a driven nozzle ring is that the preset frequency of the pulse sequence is possible by a powering of the nozzle ring. In that regard, it is preferred that the nozzle ring is driven to set the frequency of the pulse sequence at a predetermined peripheral speed.

Depending on the desired number of intertwined knots and depending on the thread speed a larger controlling range is thus possible. In one embodiment of the present invention, the peripheral velocity of the nozzle ring is adjusted in relation to the thread speed to a smaller or larger value by a maximum of 50%, such that all common BCF threads can be produced.

In order to obtain an impulse sequence of varying frequencies or varying pressure pulses, it is preferred to periodically change the peripheral speed of the nozzle ring per unit time. Thus, irregular patterns of intertwined knots in the thread can be advantageously produced. Such irregularities in the patterns can also be achieved, in which a ring nozzle is employed with non-uniformly distributed nozzle bores on the periphery, which is powered with a constant or varying peripheral speed.

According to the invention, the device has the particular advantage that in the treatment of the thread the consumption of compressed air is reduced to a minimum. Thus, a flow of pressurized air to treat the thread is made only during the pulse of air pressure through the blowing apparatus. In the phases between the pulses of compressed air, no consumption of compressed air takes place, so that the consumption compared to conventional permanent working twining apparatuses is considerably reduced.

To set the pulse sequence of pulses of compressed air and its frequency according to an advantageous embodiment of the invention device, the blowing apparatus is formed by a rotating powered nozzle ring with a peripheral thread guide track and at least one opening into the thread track nozzle bore. The nozzle ring is coupled to a compressed air source such that upon rotation of the nozzle ring, the nozzle bore is periodically connected to the compressed air source. Thus, recurring compressed air pulses at a predetermined frequency and sequence can be produced in a simple manner on the periphery of the nozzle ring.

The peripheral speed of the nozzle ring, which is proportional to the frequency of the pulse sequence of the pulse of compressed air, can be changed such that the nozzle ring is coupled with an electric motor and one of the control devices associated with the electric motor. By specifying a set frequency, the pulse sequence of compressed air pulses can be produced at a constant frequency.

In order to be able to produce particular irregular pulse sequences of compressed air pulses with irregular frequency, according to an advantageous embodiment of the invention, the electric motor is designed as an uncontrolled asynchronous motor. Thus, the random variation of the asynchronous motor can be used in order to be able to produce a random pattern of intertwined knots in the thread.

For presetting and controlling the treatment apparatus, the device according to an embodiment of the invention is advantageously designed such that the control device is connected to a central machine control unit. Thus all parameters and machine settings essential for the production of the thread can be directly input. Desired ratios between the thread speeds of the godets as well as the peripheral speed of the nozzle ring can be evaluated directly in the engine control unit and corrected accordingly.

For shielding and in particular for noise insulation it is provided further that the nozzle ring is arranged and located in an enclosure with a thread inlet and a thread outlet. The enclosure is formed with the thread inlet and the thread outlet such that the thread is at least contacted by the nozzle ring with a minimal contact arc and guided in the thread guide track. The enclosure is preferably formed with several walls, where an inner wall is preferably built out of a noise insulating material.

For holding and securing, the nozzle ring is arranged with the enclosure at a front side of a support wall, wherein the carrier at a rear wall carries the electric motor of the nozzle ring. Thus, the mechanical components can be advantageously separated from the electrical components. The delicate electronic components across from the thread area are therefore separated from the thread-guiding parts on the front side of the support wall.

BRIEF DESCRIPTION OF THE DRAWINGS

The inventive process is described in greater detail below with reference to some embodiments of the device.

DESCRIPTION

Figure 1:
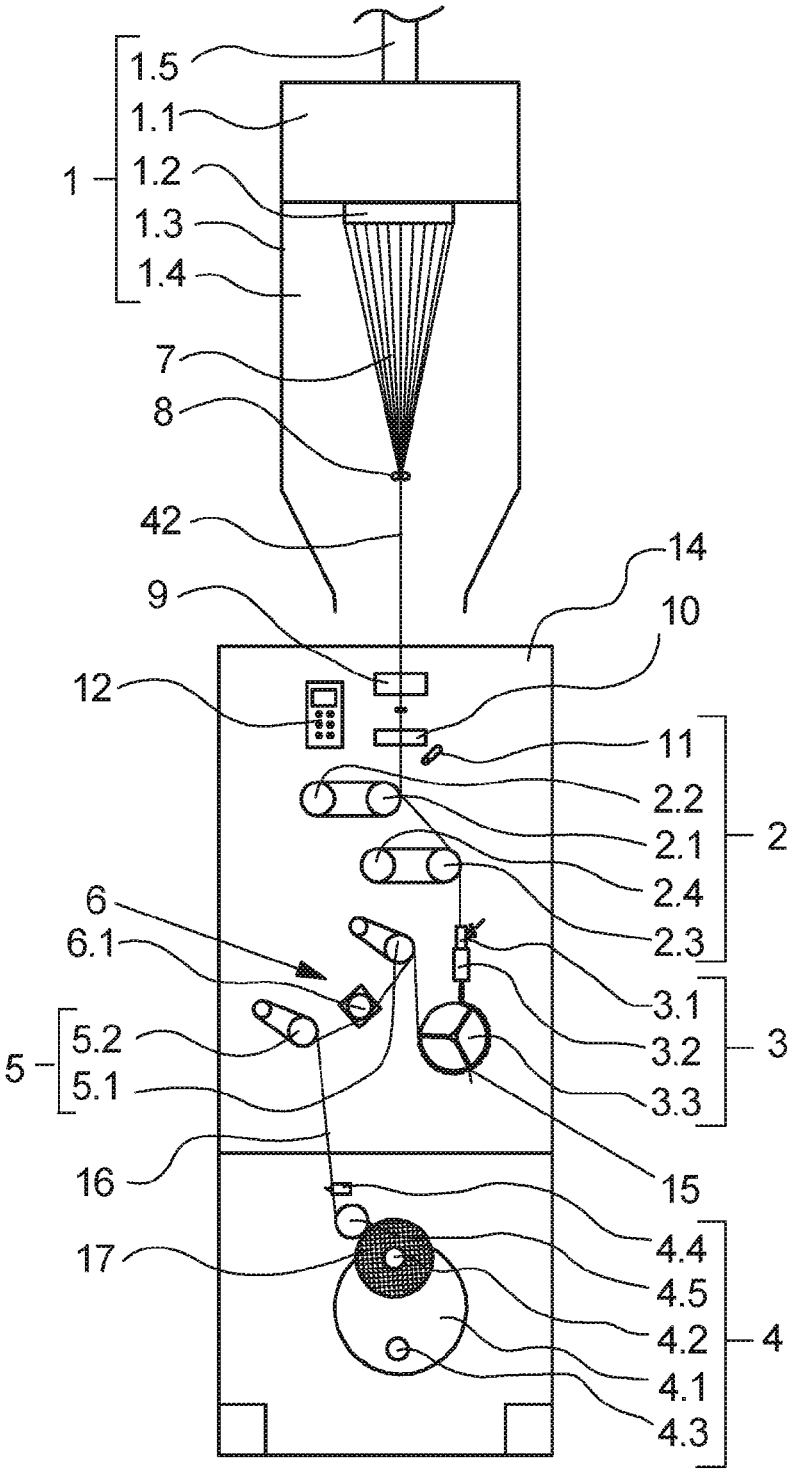
FIG. 1 is a schematic front view of an embodiment of the device according to the present invention.
Figure 2:
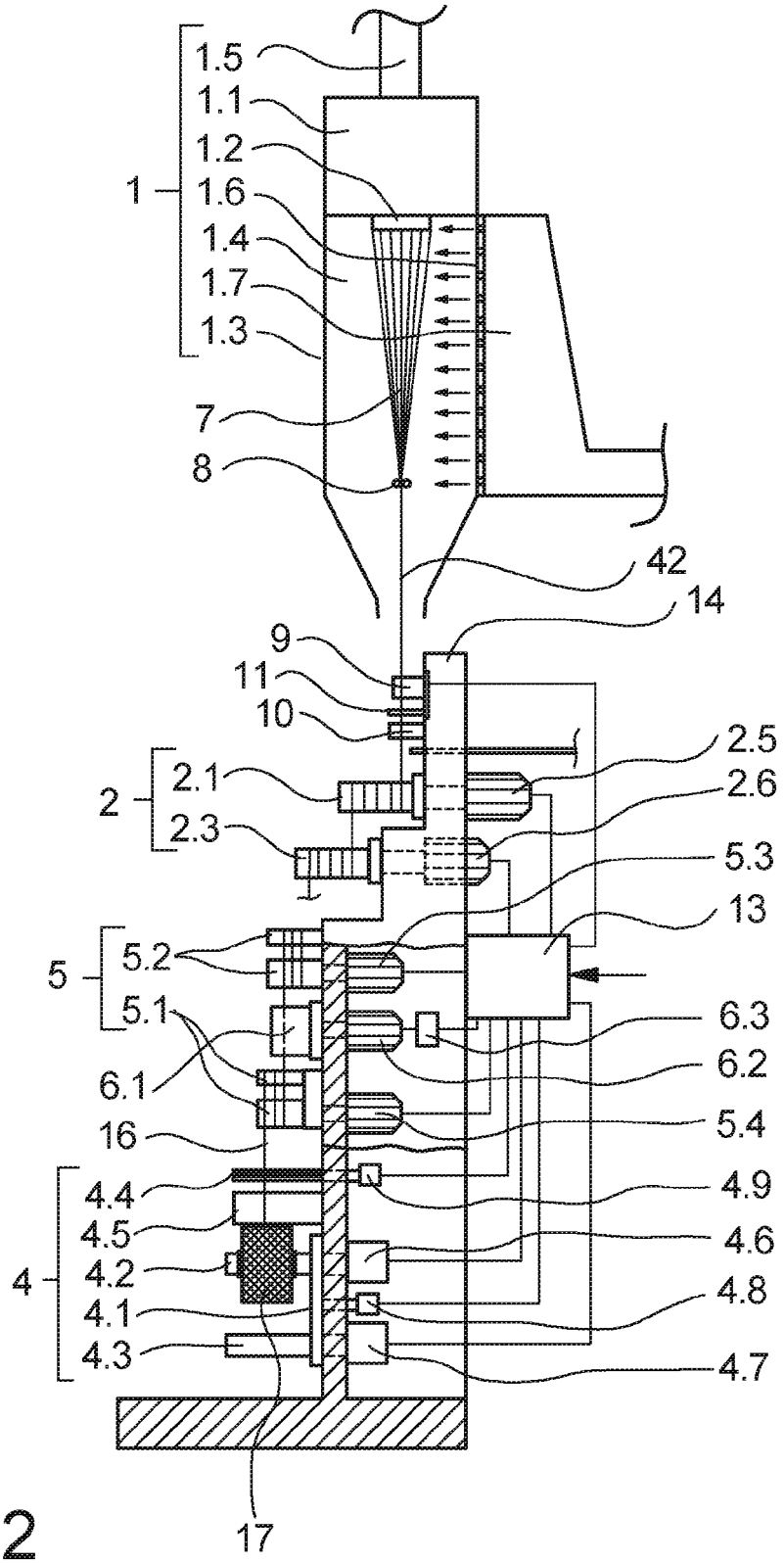
FIG. 2 is a schematic side view of the embodiment of FIG. 1.

FIGS. 1 and 2 an embodiment of the device for manufacturing a crimped multifilament thread is shown in several views. FIG. 1 shows a front view of the embodiment and FIG. 2 shows a side view of the embodiment. Here, only one thread track in each case is shown for explaining the individual facilities. In principle, such devices can be operated with a number of parallel guided threads.

Insofar as no express reference is made to one of the figures, the following description applies to both figures.

The device comprises a spinning apparatus 1, which in this embodiment comprises a spinning beam 1.1, a spinning nozzle 1.2, a spinning shaft 1.3, a cooling device 1.4, and a melt feed 1.5 to extrude from a polymer melt feed, and a number of filament strands and to cool. The spinning nozzle 1.2 is maintained for this purpose on the underside of the spinning beam 1.1, wherein the spinning beam 1.1 could still have a number of spinning nozzles, not shown here. Within the heated spinning beams 1.1, fed polymer melts of the spinning nozzle 1.2 are arranged in the distribution system and spinning pump in order to feed under pressure a melt supply 1.5 produced in the upper side.

Underneath the spinning beam 1.1, the cooling device 1.4 is arranged, which works together with the spinning shaft 1.3. The cooling device 1.4 is arranged in this embodiment as a cross-flow and includes a permeable wall 1.6 and a permeable wall connected to the pressure chamber 1.7. Thus, a transverse flow of cooling air to cool the freshly extruded filaments is produced and blown into the spinning shaft 1.3.

Below the spinning shat 1.3, a stretching device 2, a crimping device 3, and a winding device 4 are arranged in a thread path to a vertically oriented support wall 14.

In order to lead the cooled filaments as a bundle of filaments and be able to treat them, a thread guide collector 8, and preparation apparatus 9 are then attached to the stretching device 2, through which the filaments are supplied to the filament bundle. Furthermore, a thread cutter 10 and a suction port 11 are provided, in order to ensure continual spinning process into the subordinate apparatus in the event of a break in the thread. Thus, during a thread break in one of the apparatuses the filament bundle is separated by a thread cutter 10 and is led over the suction port 11 to a thread waste container.

The stretching device 2 comprises a number of heated godets 2.1 to 2.4, which are held on a protruding front face of the support wall 14. At the rear of the support wall 14, respective godet drives are associated with the godets 2.1 to 2.4. In FIG. 2, godet drive 2.5 and 2.6 are depicted.

In the thread track immediately below the stretching apparatus, the crimping device 3 is provided, which in this embodiment includes a texturing nozzle 3.1, a stuffing chamber 3.2, and a cooling drum 3.3. The texturing nozzle 3.1, the stuffing chamber 3.2, and the cooling drum 3.3 are held at the front of the carrier wall 14. The cooling drum 3.3 is rotatably mounted and coupled to a drive, not shown in FIG. 2.

Between the crimping device 3 and the winding device 4, a relaxation device 5 is provided, which comprises on the front side of the support wall two spaced apart godet units 5.1 and 5.2, which are powered by respective godet drives 5.4 and 5.3, which are retained at the support wall.

Between godet units 5.1 and 5.2, a treatment apparatus 6 is provided in order to perform compressed air treatment on the crimped multifilament thread. For this purpose, the treatment apparatus 6 comprises a controllable blowing apparatus 6.1, which is coupled to a control apparatus 6.2 and to a control apparatus 6.3 located at the rear of the support wall 14.

The winding apparatus 4 is also held at the support wall 14. For winding the thread, the winding apparatus 4 comprises two driven powered spool spindles 4.2 and 4.3, which are held on a rotatable spool spindle turret 4.1. Through the spool spindle turret 4.1, the spool spindles 4.2 and 4.3 are conducted alternately between an operating position and a changing position. In the operating position, the spool spindles 4.2 and 4.3 interact with a pressure roller 4.5 and a traversing apparatus 4.4. The drives associated with the spool spindles 4.2 and 4.3 as well as the spool turret 4.1 and the traversing apparatus 4.4 are held at the back of the support wall 14. Thus, the spindle drives 4.6 and 4.7 associated with the spool spindles 4.2 and 4.3, the turret drive 4.8 associated with the rotatable spool spindle turret 4.1, and the traversing drive 4.9 associated with the traversing apparatus 4.4 are held at the back of the support wall 14.

The associated drives and control devices at the back side of the supporting wall 14 are connected to a machine control unit 13. The engine control unit 13 is operable via an operation panel 12 positioned on the far side of the supporting wall 14. Thus, all of the functions and parameter settings can be controlled by an operator using the control panel 12.

With the device depicted in FIGS. 1 and 2, a crimped multifilament thread can be produced which is known in professional circles as bulked continuous filament (BCF) thread. Such threads are preferably used in order to produce a carpet product in a tufting process or weaving process. First, a number of filaments 7 of at least one polymer melt are extruded through the spinning nozzle 1.2. The polymer melt is produced by an extruder, not shown here, and fed through the melt feed 1.5 to the spinning beam 1.2. After the extrusion of the filaments 7, these are directly cooled by the cooling device 1.4 by means of a transversely blown cooling air stream and combined with the preparation device 9 and the collected thread guide 8 to a collection filament 42. In this case, the cohesion of the filaments 7 is generated in the filament bundle 42 substantially through a spin finish.

Subsequently, the filament bundle 42 is stretched between the godets 2.1 to 2.4 of the stretching device 2 and then crimped by the crimping apparatus 3. Inside the crimping apparatus 3, the filament bundle 42 emerges from the texturing nozzle 3.1 through the stuffing chamber 3.2 to a thread plug 15. For this purpose, the filament bundle 42 is conveyed by means of a heated fluid of the texturizing nozzle 3.1 into the stuffing chamber 3.2. The heated thread plug 15 is subsequently cooled at the periphery of the cooling drum 3.3.

The thread plug 15 is resolved to the crimped thread 16, in which the godet units 5.1 of the relaxation apparatus 5 draw the thread 16 from the cooling drum 3.3. Inside of the relaxation apparatus 5, a tension treatment takes place on the thread 16, which is essentially adjusted by the differential speed of the godet units 5.1 and 5.2. At the same time, a necessary filament end for further processing is produced on the thread 16. For this purpose, the thread is processed in the treatment apparatus 6 via a blowing apparatus 6.1 having a pulse-like flow of compressed air. Through a continuous pulse sequence of repetitive compressed air pulses which swirl across the thread 16, a number of intertwined knots are produced on the thread 16. The pulse sequence of the pressure pulse is generated at a predetermined frequency by the control apparatus 6.2 of the blowing apparatus 6.1, so that a reproducible number of uniform intertwined knots per unit length form on the thread 16. The frequency of the pulse sequence of the compressed air pulse, acting through the blowing apparatus 6.1 on the thread is set in accordance with a thread speed and is preferably such that at least 15 to 35 knots per one meter length are created on the thread 16. The thread speed can be set in this regard in a range between 2,500 m/min. to 6,000 m/min. For adjusting the frequency of the sequence to the control apparatus 6.2, the control unit 6.3 is associated with the control apparatus 6.2, in which the specifications for setting are given directly via the machine control unit 13 to the control apparatus 6.3.

Figure 3:
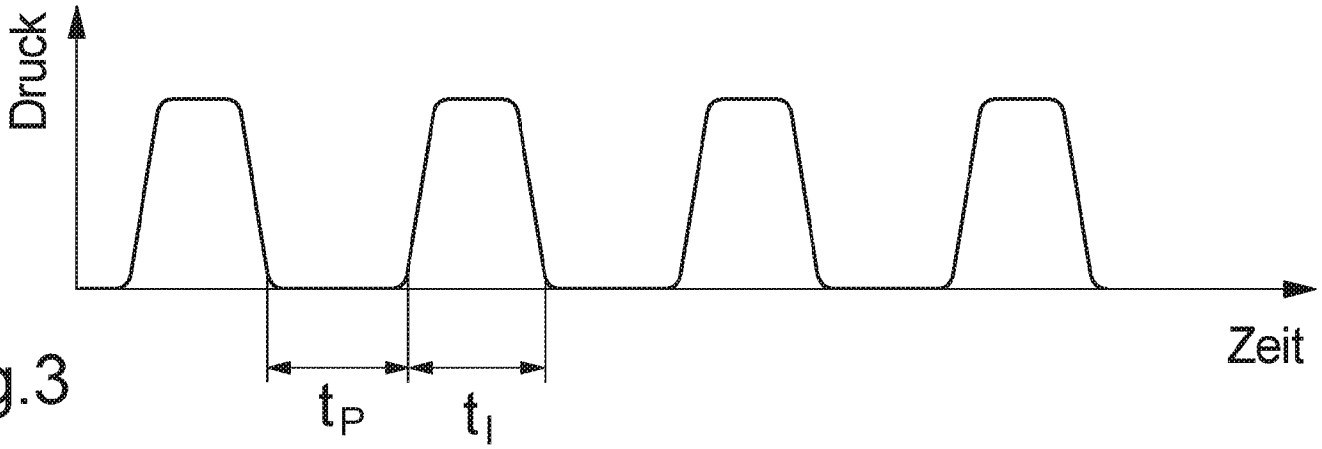
FIG. 3 is a schematic time progression of a pulse sequence of compressed air pulses.

To further illustrate the treatment apparatus 6, a pressure profile of the pressurized air pulses over time is depicted in a diagram in FIG. 3. The time axis in this case is formed by the abscissa and the pressure of the pressure pulses is shown on the ordinate.

As is apparent from the illustration in FIG. 3, the pulses of compressed air generated by the blowing apparatus 6.1 in each case are equal, whereby in each case a constant pulse time is set. The pulse time is entered on the time axis with the lower case letter $t_I$. Between successive pulses of compressed air, a rest period is established. The pause time is indicated in FIG. 3 by a lowercase letter $t_P$. Here, a periodic pressure air treatment is performed on the thread 16 with a continuous pulse sequence. The compressed air pulses are directed to the thread at a predetermined frequency so that, for example, depending on the thread speed a certain number of intertwined threads occur at a certain number of knots on the thread. At least one knot is formed on the intertwining thread per pulse of compressed air.

Figure 4:
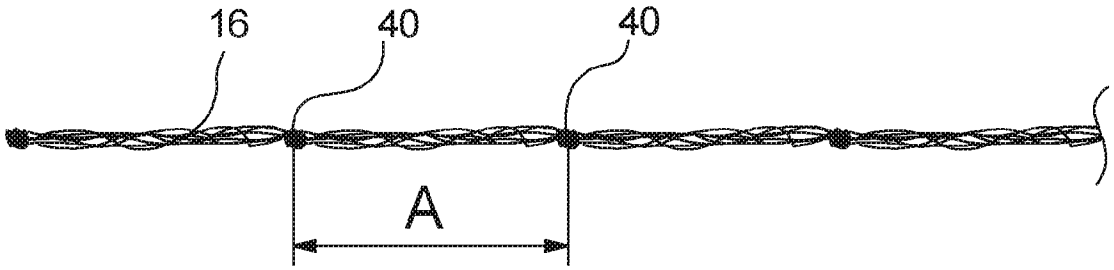
FIG. 4 is a schematic view of a multifilament thread with intertwining knots.

The change in the time interval $t_P$ between the pulses of compressed air directly affects the formation of the intertwining knots in the thread 16. In FIG. 4 a section of the thread 16 is schematically shown, wherein several intertwining knots 40 follow each other at regular intervals. The interval between adjacent intertwining knots 40 in FIG. 4 is identified with the letter A. Thus, equal spaces are created between the intertwining knots 40 by an equal pulse sequence of the pressure pulse. Since the pause time $t_P$ between the pulses of compressed air impact proportionally to the distance A between the intertwining knots 40 in the thread 16, the distance A can be also influenced by varying the pulse times.

The embodiment depicted in FIGS. 3 and 4 for the production of intertwined knots through the blowing apparatus 6.1 is only an example. Non-uniform pulse sequences of compressed air pulses with an irregular frequency can be generated by the control apparatus 6.3 associated with the blowing apparatus 6.1 such that the patterns produced in the thread 16 of the intertwined knots 40 also appear irregular. Thus regular patterns produced with high repeatability of intertwining knots as well as irregular patterns of intertwining knots are produced on the thread 16.

As is depicted in the illustration in FIGS. 1 and 2, the thread 16 is wound at the end of the process on a spool 17. In the position shown in FIGS. 1 and 2 the thread 16 of the spool spindle 4.2 is wound onto a spool 17. For this purpose, the thread is brought back and forth through the traversing apparatus 4.4 within a traverse stroke and deposited onto the pressing roller 4.5 on the surface of the spool 17.

In the device shown in FIGS. 1 and 2, the blowing apparatus 6.1 for producing the intertwining knots in the thread 16 is not specified. In principle, however, known compressed air control apparatus may be used for this purpose, which produce a compressed air pulse through an on and off switch of the compressed air source. However rotating apparatus are preferably used to produce a pulse sequence of compressed air pulses with high frequencies.

Figure 5:
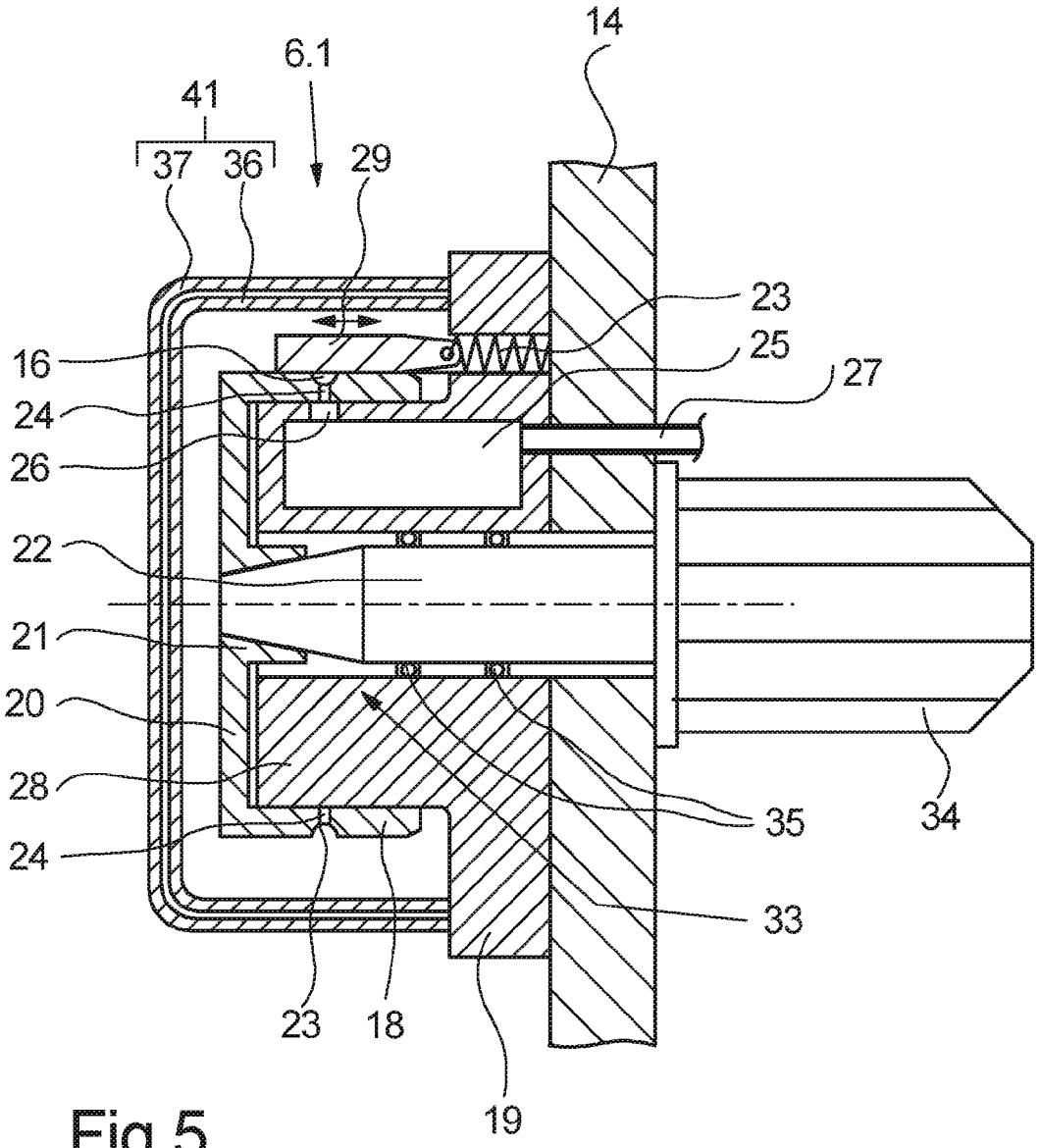
FIG. 5 is a schematic longitudinal sectional view of a blowing apparatus to produce a pulse sequence of compressed air pulses.
Figure 6:
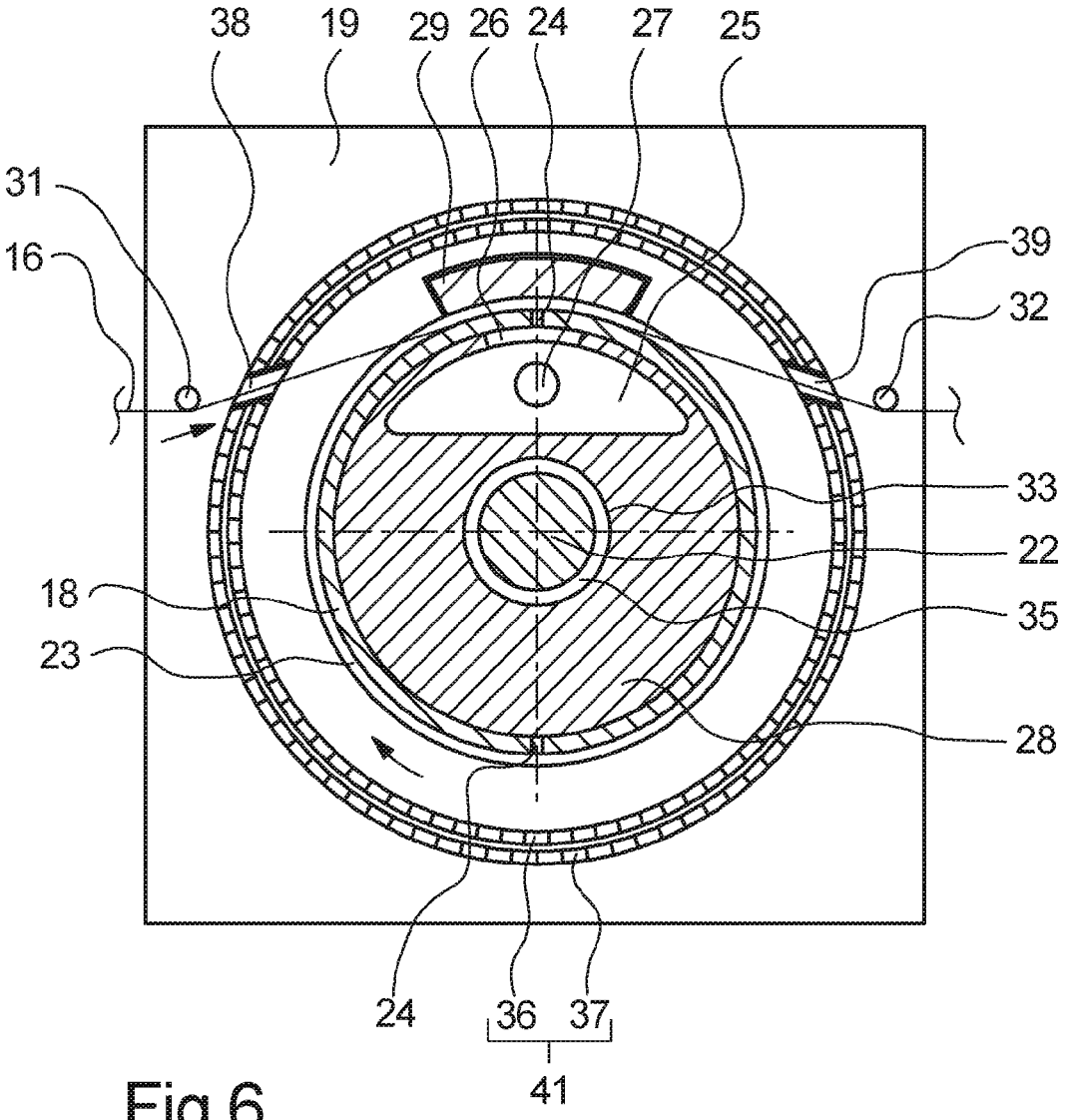
FIG. 6 is a schematic cross-sectional view of the blowing apparatus of the embodiment of FIG. 5

Thus, in FIGS. 5 and 6 an embodiment of a blowing apparatus 6.1 is shown as it would be usable in the embodiment of FIGS. 1 and 2. In FIGS. 5 and 6, the blowing apparatus 6.1 is schematically shown in several views. FIG. 5 shows the embodiment in a longitudinal section and in FIG. 6 the embodiment of the blowing apparatus 6.1 is shown in a cross section. If no express reference is made to one of the figures, then the following description applies to both figures.

The embodiment of the blowing apparatus 6.1 to produce intertwined knots in the crimped multifilament thread 16 has a rotating nozzle ring 18, which is cup-shaped and built on a front wall 20 and a hub 21 connected to a drive shaft 22. The hub 21 is secured for this purpose to a free end of the drive shaft 22.

The nozzle ring 18 is guided with a centering bore in the form of a casing to a guide collar 28 of a stator 19. At the periphery of the nozzle ring 18, a peripheral thread guide track 23 is shown, in whose groove base a nozzle bore 24 opens, which completely penetrates the nozzle ring 18 to an inner centering bore. In this embodiment, the nozzle ring 18 has two nozzle bores 24 arranged at 180° offset from one another, which open into the bottom of the thread guide track 23. Basically, the number and arrangement of the nozzle bores 24 formed in the nozzle ring 18 are by way of example. Whether one or a number of nozzle bores 24 are included in the nozzle ring 18, is dependent upon the respective process and the thread type, since the frequency of the pulse sequence 5 can be substantially influenced by the number of nozzle bores 24. In addition, the nozzle bores 24 may be formed with equally large distances or to produce certain patterns with unequal distances apart on the periphery of the nozzle ring 18.

The stator 19 has a chamber opening 26 on the periphery of the guide collar 28 at a position which is connected to a stator 19 formed in the interior of the compression chamber 25. The compression chamber 25 is connected via a compressed air connection 27 to a source of compressed air, not shown here. The chamber opening 26 of the guide collar 28 and the nozzle bores 24 in the nozzle ring 18 are formed in a plane, so that by rotation of the nozzle ring 18 the nozzle bores 24 are guided alternately in the region of the chamber opening 26. The chamber opening 26 is formed as a long hole and extends in radial direction over a longer guide area of the nozzle bore 24. The length of the chamber opening 26 thus determines the pulse time $t_I$ of the compressed air pulse.

The stator 19 is fastened on the support wall 14 and is shown with a guide collar 28 concentric with a mounting bore 33, which continues to the support wall 14. Within the mounting bore 33, the drive shaft 22 is rotatably supported by the mounting 35.

At the rear of the support wall 14, the drive shaft 22 is coupled to an electric motor 34, through which the nozzle ring 1 can be driven with a predetermined peripheral speed. The electric motor 34 acts as an actuating apparatus 6.2, and could be controlled directly from the control device 6.3 depicted in FIG. 2.

In the region of the chamber opening 26 at the periphery of the guide collar 28, a covering 29 is associated with the nozzle ring 18 at the opposite side. In this embodiment, the covering 29 is held to slide axially at the stator 19 and can be moved into a docking position for opening of the thread guide track 23. By means of a spring 23, the covering 29 is shifted into an operating position, in which an enlacement area of the thread guide track of the nozzle ring 18 is covered.

Alternatively, it is possible to tightly connect the covering 29 to the support wall 14 and to form a threading slot between the covering 29 and the nozzle ring 18, through which the thread 23 can be threaded into the thread guide track.

The nozzle ring 18 is arranged within an enclosure 41, which in this embodiment is formed by an inner housing wall 36 and an outer housing wall 37. The inner housing wall 36 is preferably formed out of a sound absorbing material to dampen the airborne sound waves excited by the compressed air pulses. The enclosure 41 is arranged on the stator 19 to be detachable. Alternatively, the enclosure 41 could be designed such that the stator 19 is sealed against the surroundings. In this case, the enclosure would be connected in a detachable fashion to the support wall 14.

For guiding the thread, the enclosure 41 includes both a thread inlet 38 and a thread outlet 39 respectively associated with an inlet thread guide 31 and an outlet thread guide 32. The thread 16 thus allows itself to be guided between the inlet thread guide 31 and the outlet thread guide 32 with a partial wrapping at the nozzle ring 18.

The inlet thread guide 31 and the outlet thread guide 32 are arranged in this embodiment outside of the enclosure 41. However, in principle it is also possible to locate the input thread guide 31 and the outlet thread guide 32 in the interior of the enclosure 41.

The inlet thread guide 31 and the outlet thread guide 32 can be formed by deflection pins or deflection pulleys. In an enclosure located outside of the thread guide, it is also possible to form the thread guides 31 and 32 directly through driven godets such that the nozzle ring 18 can be arranged directly in the thread track 10 between the godets.

Referring to the blowing apparatus shown in FIGS. 5 and 6, compressed air is introduced into the compression chamber 25 of the stator 19 for production of intertwined knots in the multifilament thread 16. The nozzle ring 18 which guides the thread 16 into the thread guide track 23, produces within the pulse time $t_I$ a compressed air pulse, as soon as one of the nozzle bores 24 reaches the region of the chamber opening 26. The air pulse is directed at the thread and leads to a local swirling on the multifilament thread 16, so that the thread forms one or more intertwined knots.

In order to execute the compressed air pulses as a pulse sequence having a predetermined frequency, the nozzle ring 18 is driven by the electric motor 34 at a predetermined peripheral speed. The peripheral speed of the nozzle ring 18 can be adjusted in proportion to the thread speed of the thread 16 according to the desired frequency in such a way that the thread 16 is guided with a slip or conveying effect. It has been demonstrated that the adjustment of the peripheral speed is chosen such that the peripheral speed of the nozzle ring 18 is adjusted relative to the thread speed of the thread 16 at a value maximally 50% smaller or larger. There is the possibility that the peripheral speed of the nozzle ring 18 is changed between a lower limit of the peripheral speed and an upper limit of the peripheral speed to produce a random pattern of intertwined knots in the thread 16. Thus an irregular pattern at the intertwining knots in the thread can be reproducibly produced by a sinusoidal variation of the peripheral speed.

Alternatively, however, it is also possible to configure the electric motor as an unregulated asynchronous motor. Here, the motor slip can be advantageously used to produce a random pattern on the intertwined knots on the thread 16.

The blowing apparatus embodiment illustrated in FIGS. 4 and 5 is thus particularly suited to produce both uniform and random patterns of intertwining knots in the thread. Such a pattern of intertwining knots in the thread can be advantageously used to preserve visual effects in the final product of a carpet material.

The method according to the invention is thus particularly suitable for producing multi-colored threads. For this purpose, three different colored bundles of filaments may be extruded in the spinning apparatus depicted in the device in FIGS. 1 and 2. They are removed in parallel fashion, stretched, and then texturized together. Such devices are well known, so at this point no further explanation is given. The production of intertwined knots in the multi-colored thread is executed as before in the embodiments according to FIGS. 1 and 2, as well as depicted and described with respect to FIGS. 5 and 6.

LIST OF REFERENCE NUMBERS

1 Spinning apparatus
1.1 Spinning beam
1.2 Spinning nozzle
1.3 Spinning shaft
1.4 Cooling device
1.5 Melt feed
1.6 Permeable wall
1.7 Compression chamber
2 Stretching device
2.1 Godet
2.2 Godet
2.3 Godet
2.4 Godet
2.5 Godet drive
2.6 Godet drive
3 Crimping apparatus
3.1 Texturing nozzle
3.2 Stuffing chamber
3.3 Cooling drum
4 Winding apparatus
4.1 Spindle turret
4.2 Spool spindle
4.3 Spool spindle
4.4 Traversing apparatus
4.5 Pressure roller
4.6, 4.7 Spindle drive
4.8 Turret drive
4.9 Traversing drive
5 Relaxing apparatus
5.1 Godet unit
5.2 Godet unit
5.3, 5.4 Godet drive
6 Treatment apparatus
6.1 Blowing apparatus
6.2 Control apparatus
6.3 Control apparatus
7 Filament
8 Collected thread guide
9 Preparation apparatus
10 Thread cutter
11 Suction port
12 Control panel
13 Machine control unit
14 Bearing wall
15 Thread plugs
16 Threads
17 Spool
18 Nozzle ring
19 Stator
20 Front wall
21 Hub
22 Drive shaft
23 Thread guide track
24 Nozzle bore
25 Compression chamber
26 Chamber opening
27 Compressed air port
28 Guide collar
29 Covering
30 Spring
31 Inlet thread guide
32 Outlet thread guide
33 Mounting bore
34 Electric motor
35 Mounting
36 Inner housing wall
37 Outer housing wall
38 Thread inlet
39 Thread outlet
40 Intertwining knots
41 Enclosure
42 Filament bundle

The invention claimed is:

1. A device for manufacturing a crimped multifilament thread comprising:

a spinning apparatus;

a stretching apparatus downstream of the spinning apparatus;

a crimping apparatus downstream of the spinning apparatus;

a treatment apparatus downstream of the spinning apparatus for producing an intertwined knot, wherein the treatment apparatus is arranged in a thread track between two driven godets; the treatment apparatus including a controllable blowing apparatus that has a rotationally driven nozzle ring with a peripheral thread guide track and at lease one nozzle bore opening into the thread guide track, which is periodically connected with a compressed air source by rotation of the nozzle ring for periodically producing a compressed air pulse directed on the thread;

an enclosure having a thread inlet and a thread outlet with the enclosure being arranged at a front side of a support wall and completely surrounding the nozzle ring to enclose the nozzle ring; and an electric motor associated with the nozzle ring, wherein a back side of the support wall supports the motor.

2. The device according to claim 1, wherein the nozzle ring is coupled to the electric motor and to a control apparatus associated with the electric motor.

3. The device according to claim 2, wherein the electric motor is an unregulated asynchronous motor.

4. The device according to claim 2, wherein the control apparatus is connected with a central machine control unit.

* * * * *